US006568004B1

(12) United States Patent
Sun

(10) Patent No.: US 6,568,004 B1
(45) Date of Patent: May 27, 2003

(54) RETRACTION CONTROL DEVICE FOR BABY JOYFUL BED

(75) Inventor: Ke-Wei Sun, Long-Tan Twon (TW)

(73) Assignee: Dongguan Crown Shin Baby Appliances Co. Ltd., Dongguan (CN)

( * ) Notice: Subject to any disclaimer, the term of this patent is extended or adjusted under 35 U.S.C. 154(b) by 0 days.

(21) Appl. No.: 10/053,590

(22) Filed: Jan. 24, 2002

(51) Int. Cl.[7] ..... A47D 7/00

(52) U.S. Cl. ..... 5/99.1; 5/93.1; 403/102; 403/322.4; 403/170

(58) Field of Search ..... 5/93.1, 98.1, 99.1; 403/101, 102, 322.4, 322.1, 321, 374.2, 169, 170, 217, 218

(56) References Cited

U.S. PATENT DOCUMENTS 5,465,439 A * 11/1995 Chien ..... 5/99.1
5,699,997 A * 12/1997 Huang ..... 256/26
6,256,814 B1 * 7/2001 Drobinski ..... 5/99.1
6,336,234 B1 * 1/2002 Kuo ..... 5/99.1
6,473,919 B1 * 11/2002 Wang ..... 5/99.1

* cited by examiner

*Primary Examiner*—Teri Pham Luu
(74) *Attorney, Agent, or Firm*—Lowe Hauptman Gilman & Berner, LLP

(57) ABSTRACT

A retraction control device especially is employed to a baby joyful bed for controlling the retraction processes of the baby joyful bed. The retraction control device includes a shell, a pad, two clips, a plate and an auxiliary stand. When the user would like to retract the baby joyful bed, the user is only needed to pull up the pad. The pad will move the clips and therefore move the plate. In this case, the four bottoms will be released, rotated and retracted downwardly. Moreover, the dynamic forces are delivered via the inclined and curved surfaces of the retraction control device.

10 Claims, 3 Drawing Sheets

RETRACTION CONTROL DEVICE FOR BABY JOYFUL BED

BACKGROUND OF THE INVENTION

1. Field of the Invention

The present invention relates to a receiving device for employing in a baby joyful bed. Particularly, the receiving device is able to be employed in a receivable baby bed and further to control the retraction process of the baby joyful bed.

2. Background Description

Since the parent was given a baby, the parent would like to safely place the baby in a baby joyful bed for ensuring the safety of the baby, rather than put the baby in open area thus causing injured accidently. However, once the baby joyful bed is placed inside the house, the space of the house is tight. In this case, the parent prefers a retractable baby joyful bed for saving house space. When the baby joyful bed is no longer needed, the baby joyful bed is able to be received in a tight storage area.

SUMMARY OF THE INVENTION

It is therefore an object of the present invention to provide a retraction control device for controlling the retraction processes of a baby joyful bed. In such case, the bed is safely retracted and therefore the baby would not be in a dangerous situation.

According to the aforementioned object of the present invention, a retraction control device is therefore developed for controlling a movement of a support, comprising a shell having at least a base for supporting the support, a pad connected to the shell, having at least a first acting surface, a pushing element positioned inside the shell, having at least a first elastic element for providing a first restoring force along a first direction, a first reacting surface and a second acting surface, wherein the first reacting surface is capable of being moved by the first acting surface, and a plate positioned inside the shell, having at least a second elastic element for providing a second restoring force along a second direction, a second reacting surface and a third acting surface, wherein the second reacting surface is capable of being moved by the second acting surface, wherein when the first acting surface jointly moves the first reacting surface, the pushing element pushes the first elastic element along the first direction; when the second acting surface jointly moves the second reacting surface, the plate moves to the opposing direction of the first direction and therefore presses the second elastic element.

Since the retraction control device is designed for deploying in a baby joyful bed, the baby joyful bed comprise a plurality of the supports, a plurality of stands, a plurality of line connection elements and a plurality of corner connection elements; wherein the retraction control device is capable of controlling the supports, the stands, the line connection elements and the corner connection elements.

In view of the above, the pad of the retraction control device further comprises a handle for a use to pull up and a rotation portion adjacent to the handle and in conjunction with the shell, having the first acting surface. Furthermore the support has a pushing rod which is inserted into the support. An elastic component is placed between the pushing rod and the support for pushing out the pushing rod.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
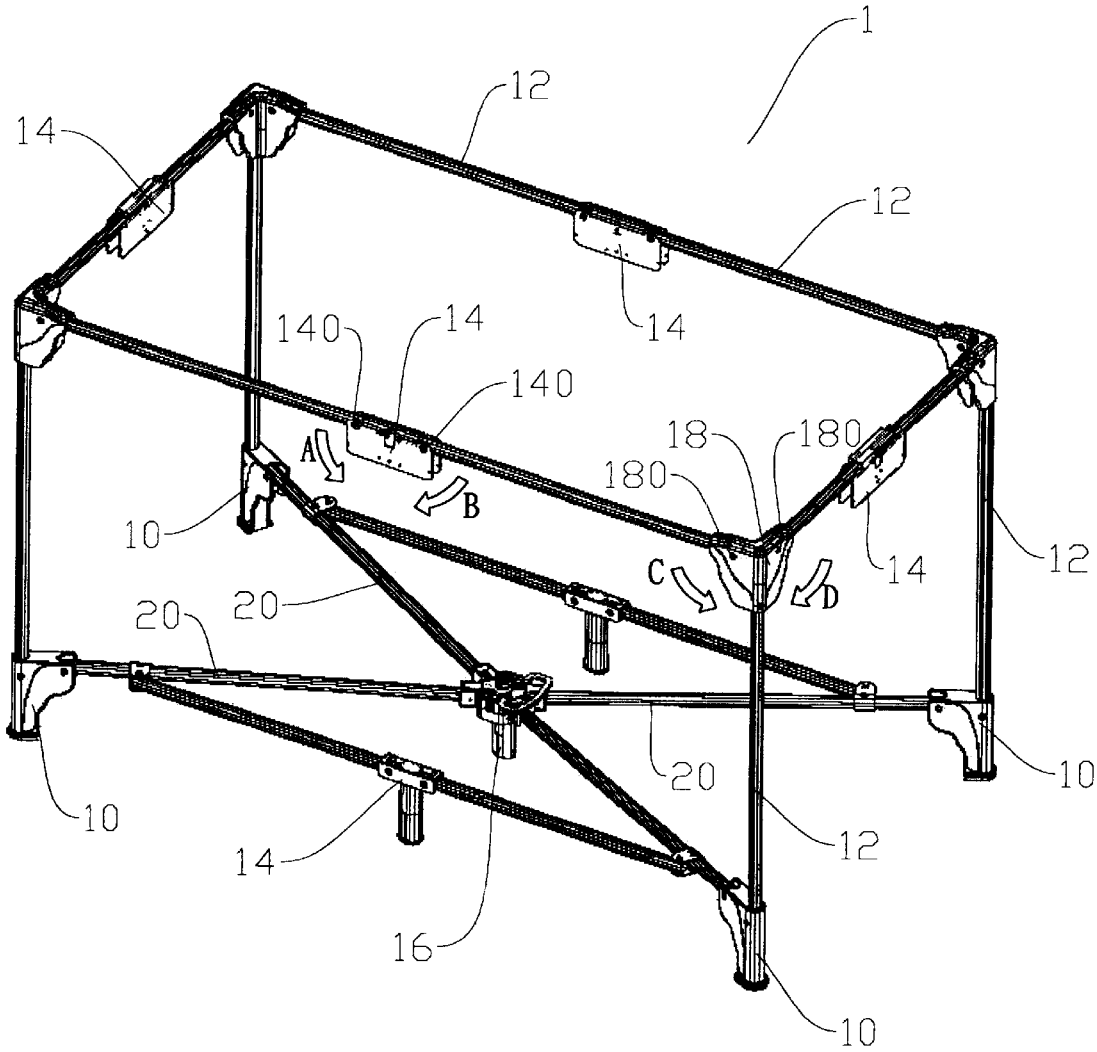
FIG. 1 shows a three-dimension schematic diagram of the present invention in actual usage status.

Please refer to FIG. 1. FIG. 1 shows the schematic status of the present invention for demonstrating three-dimension usage. The baby joyful bed 1 includes a plurality of supports 12, a plurality of stands 10, a plurality of line connection elements 14, a plurality of corner connection elements 18, a plurality of bottom 20 and a retraction control device 16. Whereas, in order to enable the baby joyful bed capable of conducting retraction, the line connection element 14 and the corner connection element 18 are connecting to the supports 12 through axles. In this case, the connected supports 12 may be bended down around the axles 140 and 180, as shown in the FIG. 1 by arrows A and B, or arrows C and D. Thus, the baby joyful bed 1 is retracted down and further controlled by the retraction control device 16. In the other words, retraction processes are centrally controlled by the retraction control device 16.

Figure 2:
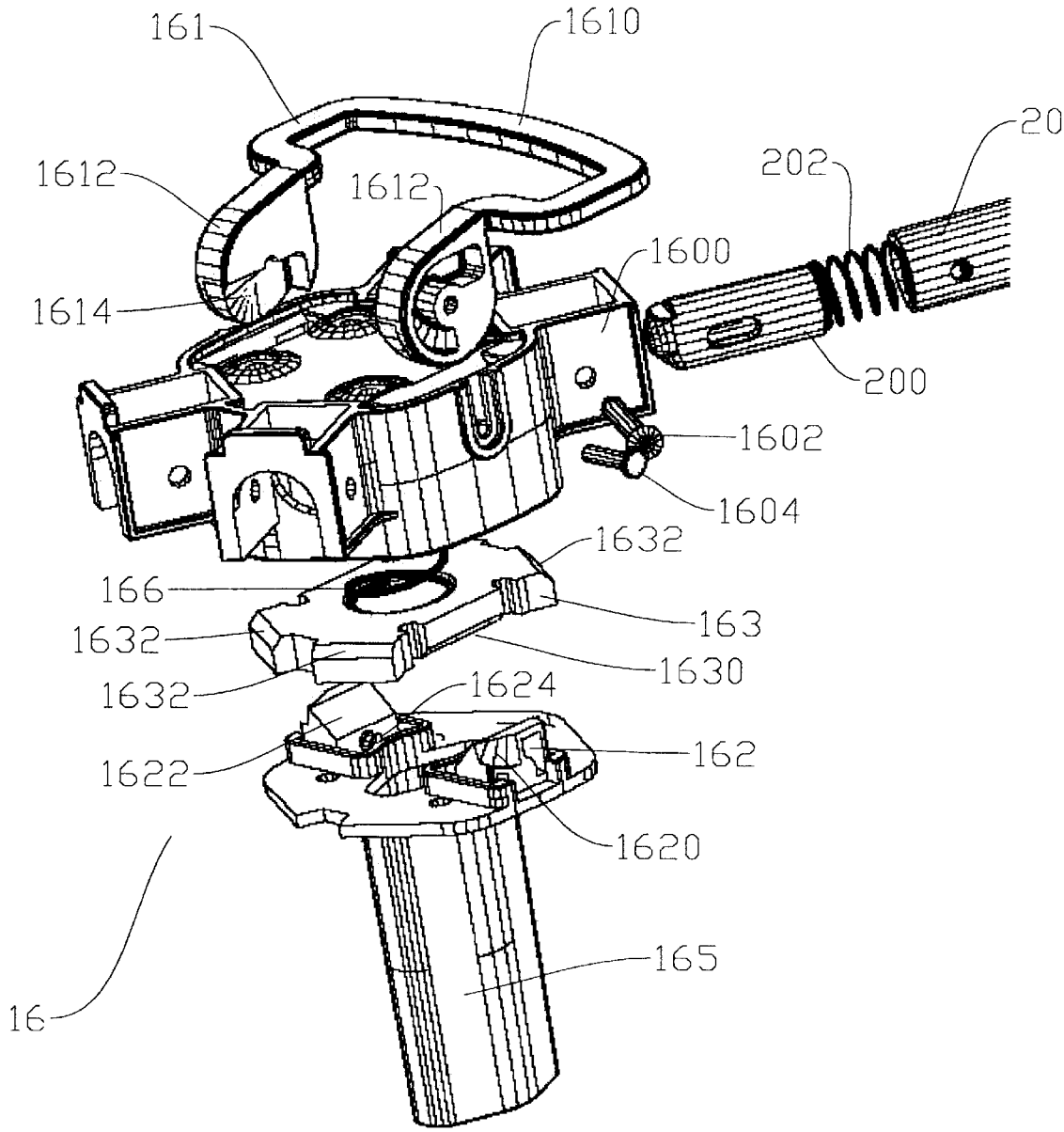
FIG. 2 is an exploded diagram showing the retraction control device of the present invention.

Please refer to FIG. 2. It is shown the retraction control device of the present invention. The retraction control device 16 includes a shell 160, a pad 161, two clips 162, a plate 163 and an auxiliary stand 165. The shell 160 contains most elements of the retraction control element 16. The shell 160 further propagates four bases 1600. The base 1600 connects four bottoms 20 via respective four pushing rods 200. Particularly, the bottom 20 is connected to the base 1600 by the axle 1602. The pushing rod 200 is received inside the bottom and pushed out by the spring 202. The pushing rod therefore pushes the shell 160 thus causing the bottom 20 unable to rotate around the axle 1602. The pad 161 is placed on the surface of the shell 160. The pad 161 includes a handle portion 1610 for being grabbed by the user and further being pulled upward, two rotation portions 1612 for connecting the shell 160 via the axle 1604. The rotation portions 1612 have curved surfaces respectively. When the handle portion of the pad 161 is pulled upwardly, the curved surface 1614 of the rotation portion 1612 will generate a downward force. The two clips 162 are inside the shell 160 and placed opposing to each other as shown in FIG. 2. Each clip contains a spring 1624 for generating restoring force in order to push the clip 162 outwardly. The plate 163 is placed in the shell 160, containing another spring 166 for generating downward restoring force. Two inclined surfaces 1630 of the plate 163 connect in opposing positions to two inclined surfaces 1622 of the clips 162. The plate 163 further has four other adjacent inclined surfaces 1632.

Figure 3:
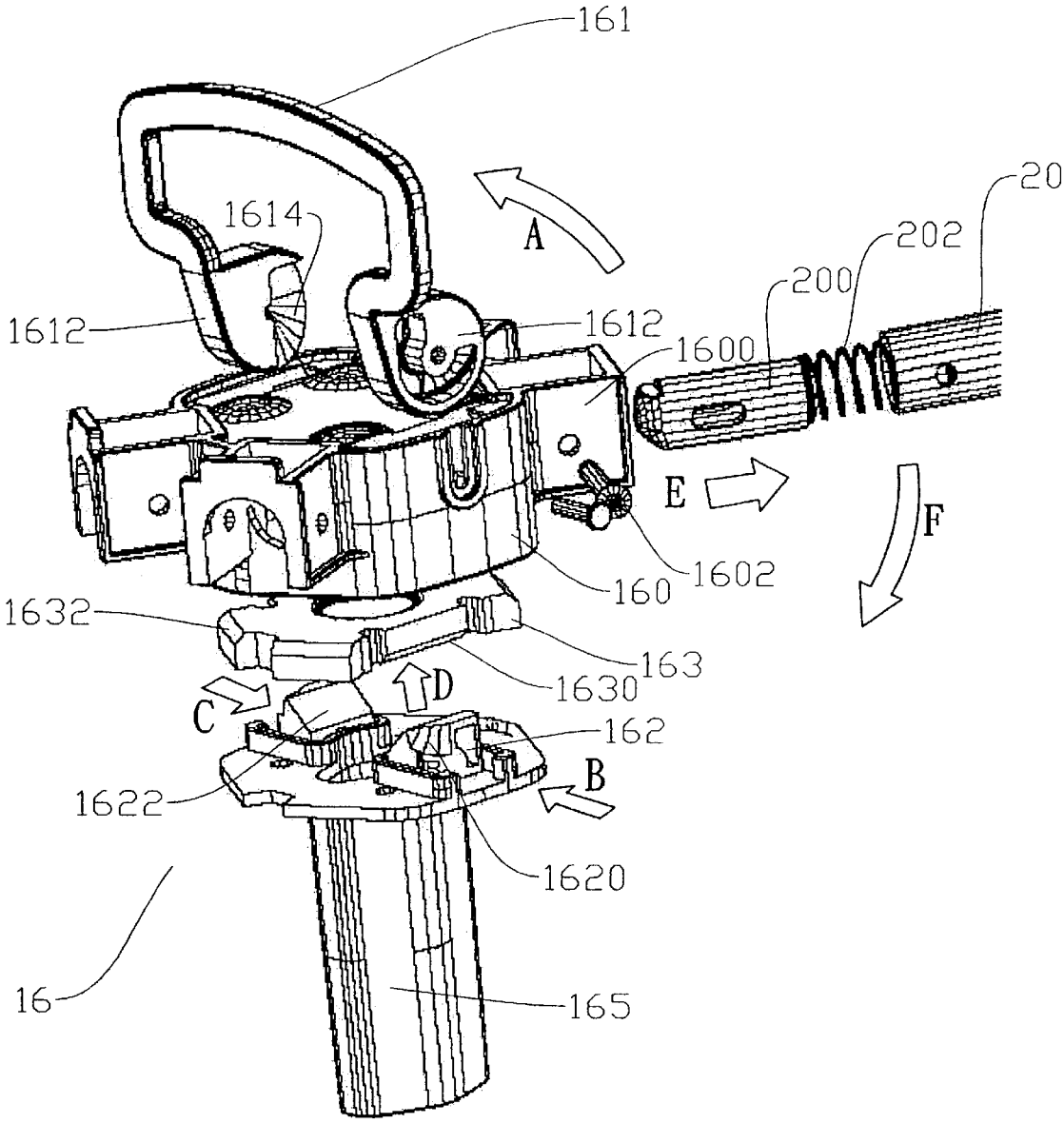
FIG. 3 shows the exploded diagram of the retraction control device when the pad is pulled up.

Referring to FIGS. 2 and 3, FIG. 3 specifically shows the status wherein the pad 161 is pulled up as indicated by the arrow A. Since the pad 161 is pulled up, the curved surface 1614 of the inclined rotation portion 1612 will jointly move the curved surface 1620 of the clips 162 for enforcing the clips slightly movement toward to the central of the shell 160, as shown in FIG. 3, the arrow B and C. At the same time, the inclined surface 1622 of the clip 162 move the plate 163 upwardly via the inclined surface 1630 of the plate 163 as shown in FIG. 3, the arrow D. In the meantime, another four inclined surfaces 1632 of the plate 163 will push out the pushing rods 200. The pushing rods 200 therefore enforce to move outwardly outside the shell 160 accordingly, as shown in FIG. 3, the arrow E. Once the pushing rods 200 leaves the shell 160 completely, the bottoms 20 would be able to rotate around the axle 1602 and thus move downwardly as shown in FIG. 3, the arrow F. Due to the retraction activity of the retraction control device 16 along with the activity of the bottoms 20, the plurality of the line connection elements 14 and the plurality of the corner connection elements 18 are also retracted downwardly. In this case, the bottoms 20 and stands 10 are able to be restored as a integrity to a tight storage area.

In the aforementioned embodiment, the movement of the clips 162 is perpendicular to the movement of the plate 163. The movement of the pushing rods 200 is also perpendicular to the movement of the plate 163.

Further in the aforementioned embodiment, the springs such as 1624, 166, 202 are designated to provide restoring forces for clips 162, plate 163 and pushing rod 200 respectively and further to ensure the pad able to return the original state. Therefore, the springs may be replaced by elastic elements for providing such elastic forces whereas the clips 162, the plate 163 and the pushing rod 200 are all capable to be restored to the original state.

Besides, when the inclined surface 1632 of the plate 163 of the retraction control device 16 pushes the pushing rod outwardly outside the shell 160 and thus the bottom 20 will rotate downwardly, the clip 162 and the plate 163 of the retraction control device 16 will return to the original state due the reaction of the restoring force provided by the elastic elements as shown in FIG. 2. In the case, when the expansion of the baby joyful bed is needed, the user may bend or rotate the bottom 20 along the direction of the arrow F shown in FIG. 3, wherein the direction is reversed from the retraction processes as aforementioned. Thus, the pushing rod 200 will butt against the shell 160. The baby joyful bed is able to be expanded to the usage status as shown in FIG. 1.

In view of the above, since the retraction control device 16 of the present invention is located in the bottom side of the baby joyful bed, and further a cover (not shown in figures) will be placed to cover the frame of the present invention and to support the baby, this cause and precaution would make the baby unable to access and approach the retraction control device of the present invention. Thus, the present invention improves additional safety to the parent's concerns. Moreover, there is able to set up an auxiliary stand 165 under the shell 160 of the retraction control device 16 for ensuring the stability and for securing the safety if the baby is naughty and moves around the baby joyful bed.

Although preferred embodiments of the present invention have been described in the forgoing description and illustrated in the accompanying drawings, it will be understood that the invention is not limited to the embodiments disclosed, but is capable of numerous rearrangements, modifications, and substituting of parts and elements without departing from the spirit and scope of the invention. Accordingly, the present invention is intended to encompass such rearrangements, modifications, and substitutions of parts and elements as fall within the scope of the appended claims.

What is claimed is:

1. A retraction control device for controlling a movement of a support, comprising:

a shell having at least a base for supporting said support;

a pad connected to said shell, having at least a first acting surface;

a pushing element positioned inside said shell, having at least a first elastic element for providing a first restoring force along a first direction, a first reacting surface and a second acting surface, wherein said first reacting surface is capable of being moved by said first acting surface; and a plate positioned inside said shell, having at least a second elastic element for providing a second restoring force along a second direction, a second reacting surface and a third acting surface, wherein said second reacting surface is capable of being moved by said second acting surface, wherein when said first acting surface jointly moves said first reacting surface, said pushing element pushes said first elastic element along said first direction; when the second acting surface jointly moves said second reacting surface, said plate moves to the opposing direction of said first direction and therefore presses said second elastic element; thus, said third acting surface moves said support.

2. The retraction control device of claim 1 is for deploying in a baby joyful bed, wherein said baby joyful bed comprises a plurality of said supports, a plurality of stands, a plurality of line connection elements and a plurality of corner connection elements; wherein said retraction control device is capable of controlling said supports, said stands, said line connection elements and said corner connection elements.

3. The retraction control device of claim 1, wherein said pad further comprising:

a handle for a use to pull up; and a rotation portion adjacent to said handle and in conjunction with said shell, having said first acting surface.

4. The retraction control device of claim 1, wherein said support has a pushing rod which is inserted into said support; an elastic component is placed between said pushing rod and said support for pushing out said pushing rod.

5. The retraction control device of claim 1, wherein the movement of said support is a rotation movement.

6. The retraction control device of claim 1, wherein said first acting surface and said first reacting surface have curved shapes.

7. The retraction control device of claim 1, wherein said second acting surface and said second reacting surface are inclined.

8. The retraction control device of claim 1, wherein said first elastic and said second elastic element are springs.

9. The retraction control device of claim 1, wherein said first direction and said second direction are perpendicular to each other.

10. The retraction control device of claim 1, wherein a third direction of said third acting surface points outwardly from said shell.

* * * * *